US012577836B2

(12) United States Patent
Huang et al.

(10) Patent No.: US 12,577,836 B2
(45) Date of Patent: Mar. 17, 2026

(54) COILED TUBING FLEXIBLE DRILL ROD ULTRA-SHORT RADIUS RADIAL DRILLING STRING, SYSTEM AND METHOD

(71) Applicant: China University of Petroleum-Beijing, Beijing City (CN)

(72) Inventors: Zhongwei Huang, Beijing City (CN); Gensheng Li, Beijing City (CN); Huaizhong Shi, Beijing City (CN); Xiaoguang Wu, Beijing City (CN); Shouceng Tian, Beijing City (CN); Xianzhi Song, Beijing City (CN); Haizhu Wang, Beijing City (CN); Mao Sheng, Beijing City (CN); Jingbin Li, Beijing City (CN); Ruiyue Yang, Beijing City (CN); Xin Liu, Beijing City (CN)

(73) Assignee: CHINA UNIVERSITY OF PETROLEUM-BEIJING, Beijing City (CN)

( * ) Notice: Subject to any disclaimer, the term of this patent is extended or adjusted under 35 U.S.C. 154(b) by 109 days.

(21) Appl. No.: 18/634,327

(22) Filed: Apr. 12, 2024

(65) Prior Publication Data

US 2024/0254837 A1 Aug. 1, 2024

Related U.S. Application Data

(63) Continuation-in-part of application No. PCT/CN2022/080157, filed on Mar. 10, 2022.

(30) Foreign Application Priority Data

Oct. 13, 2021 (CN) ..... 202111190766.7

(51) Int. Cl.
*E21B 7/06* (2006.01)
*E21B 7/04* (2006.01)
(Continued)

(52) U.S. Cl.
CPC ..... *E21B 7/061* (2013.01); *E21B 7/046* (2013.01); *E21B 17/20* (2013.01); *E21B 29/06* (2013.01); *E21B 37/02* (2013.01)

(58) Field of Classification Search
CPC . E21B 7/04; E21B 7/046; E21B 7/061; E21B 17/20; E21B 29/06
See application file for complete search history.

(56) References Cited

U.S. PATENT DOCUMENTS 4,678,045 A 7/1987 Lyons
6,364,038 B1 4/2002 Driver
(Continued)

FOREIGN PATENT DOCUMENTS

CN 101078335 A 11/2007
CN 101832105 A 9/2010
(Continued)

OTHER PUBLICATIONS

International Search Report and Written Opinion mailed Jul. 15, 2022, Application No. PCT/CN2022/080157—Translation Only of Search Report.
(Continued)

*Primary Examiner* — Tara Schimpf
*Assistant Examiner* — Lamia Quaim
(74) *Attorney, Agent, or Firm* — The Dobrusin Law Firm, P.C.; Daniela M. Thompson-Walters

(57) ABSTRACT

A coiled tubing flexible drill rod ultra-short radius radial drilling method, including: when in a first operation mode, activating a screw motor and a flexible power drilling tool located at a lower part of a coiled tubing; when in a second operation mode, only activating the screw motor and deactivating the flexible power drilling tool; and when in a third operation mode, only activating the flexible power drilling tool connected to the drill bit below. A corresponding
(Continued)

drilling string and system are also disclosed. The method and system can achieve the effects of a small deflecting radius, an adjustable deflecting angle, a high operating efficiency and a low risk.

17 Claims, 5 Drawing Sheets

(51) Int. Cl.

| | |
|---|---|
| ***E21B 17/20*** | (2006.01) |
| ***E21B 29/06*** | (2006.01) |
| ***E21B 37/02*** | (2006.01) |

(56) References Cited

U.S. PATENT DOCUMENTS

| | | | | |
|---|---|---|---|---|
| 6,446,737 | B1 | 9/2002 | Fontana et al. | |
| 2009/0000824 | A1 | 1/2009 | Cao et al. | |
| 2015/0368975 | A1* | 12/2015 | Zupanick | E21B 4/18 175/76 |
| 2016/0312536 | A1 | 10/2016 | Tan | |
| 2024/0263519 | A1* | 8/2024 | Xu | E21B 7/062 |

FOREIGN PATENT DOCUMENTS

| | | | |
|---|---|---|---|
| CN | 201588543 | U | 9/2010 |
| CN | 202047748 | U | 11/2011 |
| CN | 102654035 | A | 9/2012 |
| CN | 105064919 | A | 11/2015 |
| CN | 106471205 | A | 3/2017 |
| CN | 109854174 | A | 6/2019 |
| CN | 209724225 | U | 12/2019 |
| CN | 111577141 | A | 8/2020 |
| CN | 111946263 | A | 11/2020 |
| CN | 114109249 | A | 3/2022 |
| EP | 1245783 | A2 | 10/2002 |
| WO | 2015106419 | A1 | 7/2015 |

OTHER PUBLICATIONS

First Office Action and Search Report issued on Aug. 16, 2022, for counterpart Chinese patent application No. 202111190766.7.

Supplemental Search Report issued on Oct. 26, 2022, for counterpart Chinese patent application No. 202111190766.7.

Li Gensheng et al., Research progress and prospects of well drilling and completion with coiled tubing, Petroleum Science Bulletin, vol. 1 No.1, p. 81-90, 2016.

Fang Jun et al., Mechanical Properties of Torsion-Resistant Milling BHA for CT Sidetracking, Petroleum Drilling Techniques, vol. 45 No.2, p. 46-53, 2017.

* cited by examiner

COILED TUBING FLEXIBLE DRILL ROD ULTRA-SHORT RADIUS RADIAL DRILLING STRING, SYSTEM AND METHOD

CROSS-REFERENCE TO RELATED APPLICATIONS

The present application is a continuation-in-part of International Application No. PCT/CN2022/080157, filed on Mar. 10, 2022, which claims priority to Chinese Patent Application No. 202111190766.7, filed on Oct. 13, 2021, and entitled "coiled tubing flexible drill rod ultra-short radius radial drilling string, system and method", all of which are hereby incorporated by reference in their entireties.

FIELD

The present disclosure relates to the technical field of oil exploitations, and particularly to a coiled tubing flexible drill rod ultra-short radius radial drilling string, system and method.

BACKGROUND

In recent years, the development of low permeability and ultra-low permeability oilfields has been strengthened in China, and the successful development of the radial well (i.e., horizontal well) technology has become one of the effective means to develop low permeability and ultra-low permeability oilfields. Based on the horizontal well drilling, the deflecting rate is increased, so that window cutting, deflection and horizontal section drilling can all be completed in the same oil layer. Such ultra-short radius radial horizontal well technology can revive old wells, greatly improve the oil well production and the crude oil recovery, and is one of the effective means to transform old wells in the oil fields, tap the reservoir potentials and stabilize and increase the production, and is especially suitable for the development of oil reservoirs with thin oil layers, vertical fractures, heavy oil and low permeability, etc.

Conventional sidetracking in branch wells usually uses a workover rig to cooperate with the drill rod. The workover rig provides a torque for drill rod through a rotary table and controls a weight on bit. During tripping, the connection is frequently made, which greatly increases the drilling cycle and the operation cost. Meanwhile, the conventional drill rod is long, so it is difficult to achieve a rapid deflection, and the deflecting radius reaches tens of meters or even hundreds of meters, resulting in useless footage and high drilling risk.

In view of the above difficulties in drilling the branch wells, it is necessary to provide a new coiled tubing flexible drill rod ultra-short radius radial drilling string, system and method.

SUMMARY

In order to overcome the above defects of the prior art, the technical problem to be solved by the embodiments of the present invention is to provide a coiled tubing flexible drill rod ultra-short radius radial drilling string, system and method, so as to achieve a small deflecting radius, an adjustable deflecting angle, high operation efficiency and low risk.

In order to achieve the above objective, the present disclosure adopts the following technical solutions:

A coiled tubing flexible drill rod ultra-short radius radial drilling method for a coiled tubing flexible drill rod ultra-short radius radial drilling system, wherein the system comprises a plurality of operation modes, and the method includes: when the coiled tubing flexible drill rod ultra-short radius radial drilling system is in a first operation mode, activating a screw motor and a flexible power drilling tool located at a lower part of a coiled tubing. A drill bit is mounted at a lower end of a flexible drill rod, and both the screw motor and the flexible power drilling tool provide a torque and a weight on bit for the flexible drill rod and the drill bit. During operation, the screw motor remains in a main wellbore without entering a branch wellbore, so as to realize ultra-short radius radial drilling; when the coiled tubing flexible drill rod ultra-short radius radial drilling system is in a second operation mode, only activating the screw motor and deactivating the flexible power drilling tool. A lower end of the screw motor is connected to the flexible drill rod, and the drill bit is mounted at the lower end of the flexible drill rod. During operation, the screw motor does not enter the branch wellbore, and provides a torque for the flexible drill rod and the drill bit. During drilling, a rotation speed of the flexible drill rod is controlled through a displacement (flow rate), and an operating weight on bit is determined based on a rated torque of the screw motor; and when the coiled tubing flexible drill rod ultra-short radius radial drilling system is in a third operation mode, only activating the flexible power drilling tool connected to the drill bit below. During operation, the screw motor is deactivated, the flexible drill rod does not rotate, and the flexible power drilling tool enters the sidetrack drilling branch wellbore along with the drill bit to directly provide a torque for the drill bit to realize rotary drilling.

A coiled tubing flexible drill rod ultra-short radius radial drilling string, which at least includes a flexible drill rod and a flexible power drilling tool. The flexible drill rod includes a plurality of flexible pup joints, any adjacent two of which are connected by a movable mechanism which can transfer both a torque and a weight on bit. The flexible power drilling tool includes a flexible drilling tool upper joint, and a central transmission rod connected to the flexible drilling tool upper joint. The central transmission rod is a hollow revolution structure and includes a tube body part located on the flexible drilling tool upper joint and a ball head part extending out of the flexible drilling tool upper joint; a mandrel is provided inside the central transmission rod. A turbine power unit is provided between the tube body part and the mandrel, one end of the mandrel extending out of the flexible drilling tool upper joint is in transmission connection with a first fluid director, the first fluid director is in transmission connection with the ball head part, the ball head part is in transmission connection with a limiting sleeve through a ball, and the limiting sleeve is connected to a flexible drilling tool lower joint. When drilling fluid flows through the turbine power unit, the turbine power unit drives the mandrel to rotate, the mandrel causes the central transmission rod to rotate through the first fluid director, and the central transmission rod causes the flexible drilling tool lower joint to rotate through the ball and the limiting sleeve.

A coiled tubing flexible drill rod ultra-short radius radial drilling system, including the above coiled tubing flexible drill rod ultra-short radius radial drilling string, and a whipstock device and a hydraulic anchor in a main wellbore.

The technical solutions of the present disclosure have the following obvious advantageous effects:

The present disclosure provides a coiled tubing flexible drill rod ultra-short radius radial drilling string, system and method, and proposes a brand-new flexible drill rod and flexible power drilling tool, which can realize ultra-short radius deflection with an arbitrary curvature radius in a range of 1 m to 12 m when being applied in the string for operation, with an adjustable deflecting rate of 5°/m to 57°/m, and can complete window cutting, deflection and drilling in the same thin layer, thus reducing useless footage and avoiding complex accident risks such as clay expansion and water hole blockage during drilling of upper mudstone and other caprocks. Meanwhile, by combining the coiled tubing with the flexible drill rod and the flexible drilling tool, the frequent single connection in the conventional method is avoided, which helps to realize rapid and efficient deflection drilling and shorten the construction period and cost. In addition, the present disclosure is suitable for pressurized operations, which is convenient for further performing a fracturing operation and a well completion operation after the formation of the branch wellbore.

With reference to the following description and drawings, the specific embodiments of the present disclosure are disclosed in detail, and the ways in which the principles of the present disclosure can be adopted are pointed out. It should be understood that the embodiments of the present disclosure are not limited in scope. In the scope of the spirit and clauses of the appended claims, the embodiments of the present disclosure include many changes, modifications and equivalents. The features described and/or illustrated with respect to one embodiment may be used in one or more other embodiments in the same or similar way, may be combined with the features in other embodiments, or may take place of those features.

BRIEF DESCRIPTION OF THE DRAWINGS

The drawings described here are for explanatory purposes only and are not intended to limit the scope of the present disclosure in any way. In addition, the shapes and scales of components in the drawings are only schematic to help the understanding of the present disclosure, rather than specifically limiting the shapes and scales of components in the present disclosure. Under the teaching of the present disclosure, persons skilled in the art can select any possible shape and scale to implement the present disclosure according to specific situations.

DETAILED DESCRIPTION

Figure 1:
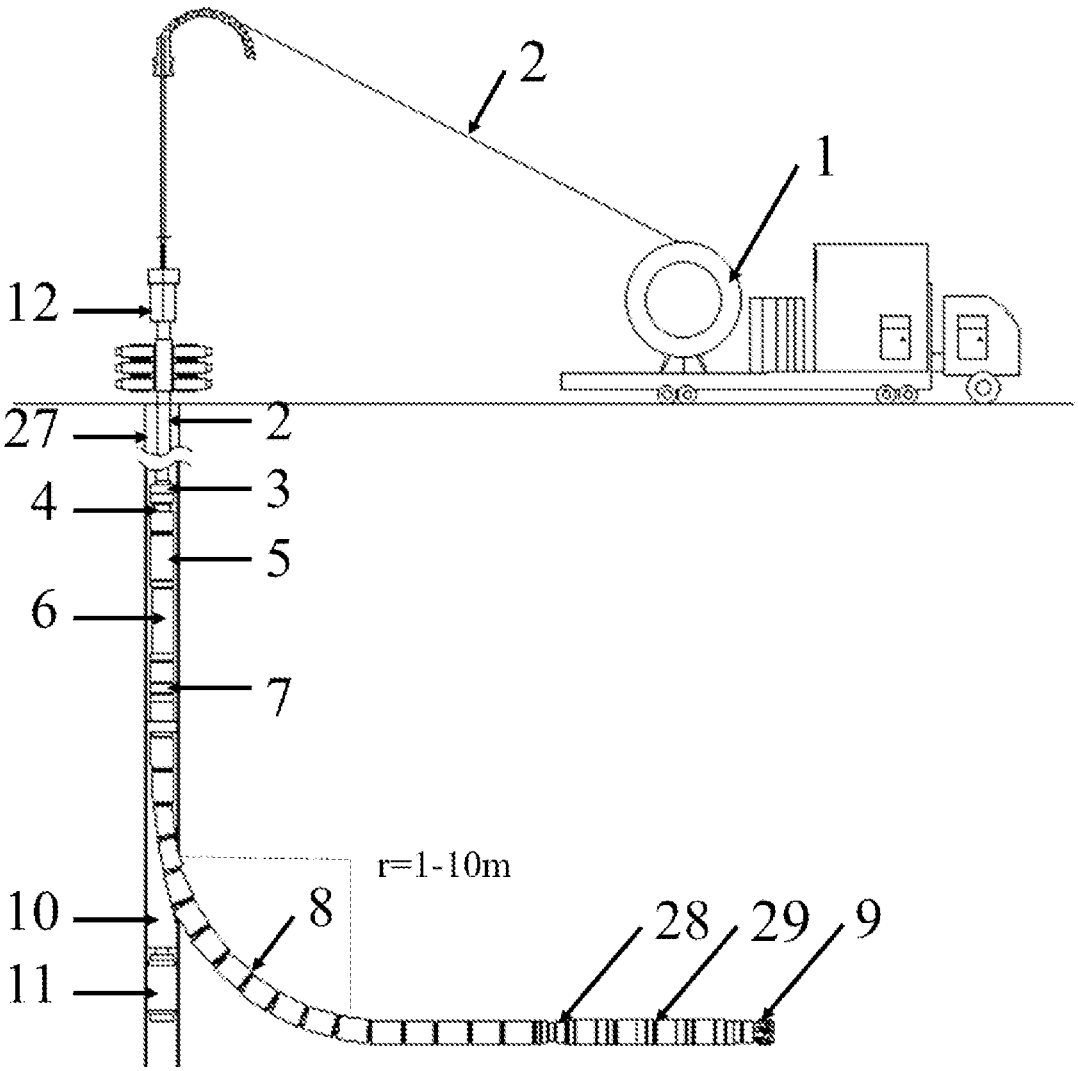
FIG. 1 is a schematic diagram of an ultra-short radius horizontal well sidetracking operation system according to the present disclosure.

The technical solutions of the present disclosure will be described in detail below with reference to the drawings and the specific embodiments. It should be understood that those embodiments are intended only to illustrate the present disclosure rather than limiting the scope thereof. After reading the present disclosure, various equivalent modifications to the present disclosure made by persons skilled in the art should fall within the scope defined by the appended claims of the present disclosure.

It should be noted that when an element is referred to as being 'provided on' another element, it may be directly on another element or there may be an intervening element. When an element is considered as being 'connected to' another element, it may be directly connected to another element or there may be an intervening element. The terms 'vertical', 'horizontal', 'upper', 'lower', 'left', 'right' and similar expressions used herein are for the purpose of illustration only, and are not intended to be exclusive embodiments.

Unless otherwise defined, all technical and scientific terms used herein have the same meanings as commonly understood by persons of ordinary skills in the art of present disclosure. The terms used in the present disclosure are only for the purpose of describing the specific embodiments, and are not intended to limit present disclosure. As used herein, the term 'and/or' includes any or all combinations of one or more related listed items.

Referring to FIGS. 1 to 6, the present disclosure provides a coiled tubing flexible drill rod ultra-short radius radial drilling string, which may at least include a flexible drill rod 8 and a flexible power drilling tool 29. The flexible drill rod 8 includes a plurality of flexible pup joints 17, any adjacent two of which are connected by a movable mechanism which can transmit both a torque and a weight on bit. The flexible power drilling tool 29 includes a flexible drilling tool upper joint 291, and a central transmission rod 295 connected to the flexible drilling tool upper joint 291. The central transmission rod 295 is a hollow revolution structure, including a tube body part located on the flexible drilling tool upper joint 291 and a ball head part extending out of the flexible drilling tool upper joint 291. A mandrel 2913 is provided inside the central transmission rod 295. A turbine power unit is provided between the tube body part and the mandrel 2913. One end of the mandrel 2913 extending out of the flexible drilling tool upper joint 291 is in transmission connection with a first fluid director 2912. The first fluid director 2912 is in transmission connection with the ball head part. The ball head part is in transmission connection with a limiting sleeve 296 through a ball 297. The limiting sleeve 296 is connected to a flexible drilling tool lower joint 299. When drilling fluid flows through the turbine power unit, the turbine power unit drives the mandrel 2913 to rotate, the mandrel 2913 causes the central transmission rod 295 to rotate through the first fluid director 2912, and the central transmission rod 295 causes the flexible drilling tool lower joint 299 to rotate through the ball 297 and the limiting sleeve 296.

Based on the above coiled tubing flexible drill rod ultra-short radius radial drilling string, the embodiments of the present disclosure further provide a coiled tubing flexible drill rod ultra-short radius radial drilling system, which further includes supporting equipment in a main wellbore 27, such as a whipstock device 13, a hydraulic anchor 11, etc.

According to the present disclosure, the coiled tubing flexible drill rod ultra-short radius radial drilling system is used to realize ultra-short radius radial well drilling with coiled tubing 2, and a ultra-short radius deflection of any curvature radius in a range of 1 m to 12 m with an adjustable build-up rate from 5°/m to 57°/m, so that window cutting, deflection and drilling can all be solved within a same thin layer without exiting the layer, thus reducing useless footage and avoiding complex accident risks such as clay expansion and water hole blockage during drilling of upper mudstone and other caprocks. Meanwhile, the combination of the coiled tubing 2 and the flexible drill rod 8 avoids the frequent single connection in the conventional method, and is helpful to realize rapid and efficient deflection drilling and shorten the construction period and cost.

The detailed description is made with reference to the specific drawings and embodiments.

In the coiled tubing flexible drill rod ultra-short radius radial drilling system provided in the present disclosure, the coiled tubing 2 is combined with the flexible drill rod 8, and the land operating machine is an operating vehicle 1. The borehole drilling tool assembly may include, from top to bottom, a coiled tubing 2, a connector 3, a non-rotary joint 4, a safety release 5, a weighted drill rod 6, a screw motor 7, a flexible drill rod 8, a rotary joint 28, a flexible power drilling tool 29, and a drill bit 9.

The coiled tubing 2 is used to lift up and down the tool string, and the drilling can be performed in the following three situations:

1—drilling mode 1: activating the screw motor 7, the borehole flexible drill rod 8, and the flexible power drilling tool 29 to cooperate with the drill bit 9 to complete the ultra-short radius multi-branch well drilling;

2—drilling mode 2: only activating the screw motor 7 to cooperate with the drill bit 9 for rotary drilling;

3—drilling mode 3: only activating the flexible power drilling tool 29 to cooperate with the drill bit 9 for drilling.

For the drilling mode 1, both the high-torque low-speed screw motor 7 and the flexible power drilling tool 29 that is located at the lower part of the coiled tubing 2 are activated. The drill bit 9 is mounted at the lower end of the flexible drill rod 8. Both the screw motor 7 and the flexible power drilling tool 29 provide torques and weights on bit for the flexible drill rod 8 and the drill bit 9, thus providing enough torque.

For the drilling mode 2, only the high-torque low-speed screw motor 7 is activated to drive the flexible drill rod 8 and the drill bit 9 that are located below the screw motor 7. This method is relatively simple, but the friction between the flexible drill rod 8 and the borehole wall needs to be overcome.

For the drilling mode 3, the screw motor 7 is deactivated, the appearance and connection mode of the flexible power drilling tool 29 are consistent with those of the flexible drill rod 8, the flexible power drilling tool 29 is above the drill bit 9 and is directly connected to the drill bit 9, and the flexible drill rod 8 does not rotate. In this mode, the torque directly acts on the drill bit 9, thus effectively improving the extensibility of the radial well.

Therefore, in actual operations, the operating systems corresponding to the above three drilling modes can be selected according to the target length of the radial well.

In the present disclosure, the coiled tubing 2 is used to lift up and down the tool string, and the flexible power drilling tool 29 is cooperated with the screw motor 7. Specifically, the flexible power drilling tool 29 is connected to the lower part of the screw motor 7 through the flexible drill rod 8 and the rotary joint 28, and the drill bit 9 is mounted at the lower end of the flexible power drilling tool.

In the present disclosure, the screw motor 7 remains in the main wellbore 27 without entering the branch well to provide a torque for the flexible power drilling tool 29 and the drill bit 9. The flexible drilling tool 29 and the drill bit 9 enter the sidetracking branch to realize the ultra-short radius multi-branch well drilling.

The screw motor 7 is a high-torque low-speed motor, which adopts a high-power rubber material, a high-torque universal shaft and a high-strength transmission shaft, so as to generate sufficient power to overcome the friction between the flexible drill rod 8 and the borehole wall, while providing an enough torque (not less than 3 KN·m) for the drill bit 9.

The flexible drill rod 8 and the flexible power drilling tool 29 are formed by pup joints connected in sequence, each of which has a length of 0.15 m to 0.25 m. The adjacent pup joints are movably connected to each other in a ball cage type, which can transfer both the torque and the weight on bit.

Figure 3:
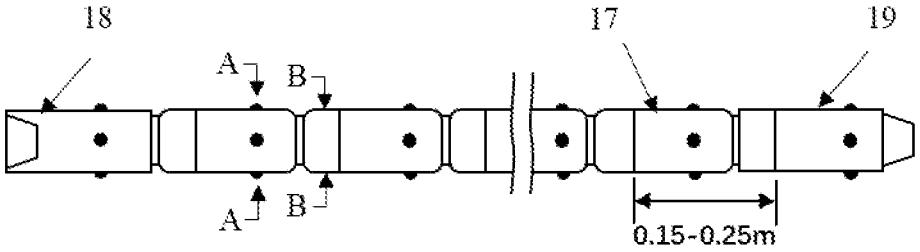
FIG. 3 is a schematic structural diagram of a flexible drill rod according to the present disclosure.

Referring to FIG. 3, the flexible drill rod 8 may include a plurality of flexible pup joints 17, a flexible-drill-rod upper joint 18 and a flexible-drill-rod lower joint 19.

Figure 4A:
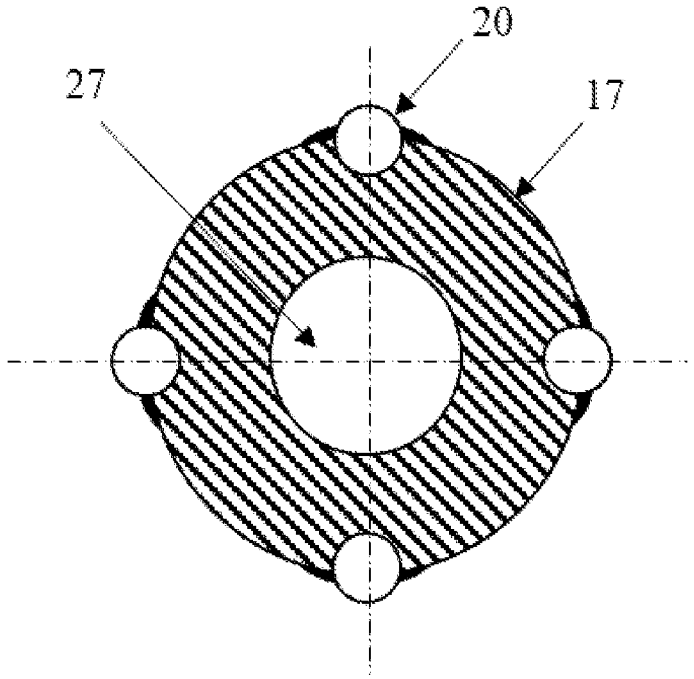
FIG. 4A is a cross-sectional view taken at a flexible connection position A-A of a pup joint of the flexible drill rod in FIG. 3.
Figure 4B:
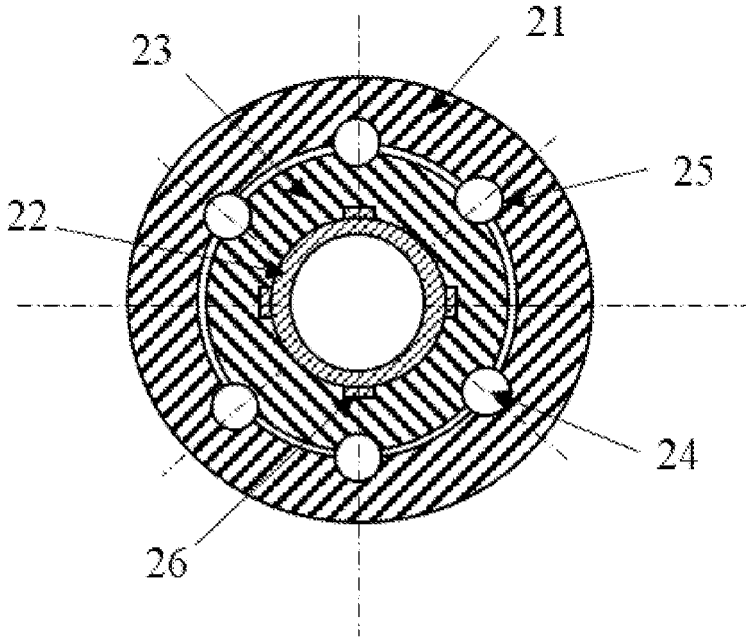
FIG. 4B is a cross-sectional view taken at a position B-B of a rolling ball of the flexible drill rod in FIG. 3.

Referring to FIGS. 4A and 4B, in one embodiment, a ball cage sleeve 21, a star sleeve 23, and a shaft tube 22 are provided from outside to inside at the connecting position of any adjacent two of the flexible pup joints 17. A circumferential limiting mechanism 26 for torque transmission is provided between the shaft tube 22 and the star sleeve 23. A spherical guide groove 25 is formed between the ball cage sleeve 21 and the star sleeve 23, and a cemented carbide ball 24 for torque transmission is provided in the guide groove 25.

Further, the guide groove 25 serves as a limiting mechanism, and the cemented carbide ball 24 can rolls in a limiting space defined by the limiting mechanism, so that a maximum bending angle of the flexible pup joint 17 can be adjusted by changing the size of the limiting space.

The flexible drill rod 8 may be formed by connecting a plurality of flexible pup joints 17. The upper joint 18 is connected to the screw motor 7 through a crossover joint, and the lower joint 19 is connected to the drill bit 9 or a milling cone. A steel ball 20 is mounted on the body of the flexible pup joint 17 in a ball cage type movable connection mode, which can realize relative bending at a certain angle.

Specifically, the connecting position is provided with the ball cage sleeve 21, the shaft tube 22, the star sleeve 23, the cemented carbide ball 24, the guide groove 25, and a keyway between the star sleeve 23 and the shaft tube 22. The guide grooves 25 is provided between an inner side of the ball cage sleeve 21 and an outer side of the star sleeve 23, and the cemented carbide ball 24 is maintained in the guide groove 25 by the star sleeve 23 for torque transmission.

The ball cage sleeve 21 and the star sleeve 23 may be uniformly provided with 4 to 6 guide grooves 25 in the circumferential direction, each of the guide grooves 25 is mounted with one cemented carbide ball 24, and the torque at the flexible connection part (between the star sleeve 23 and the shaft tube 22) may be uniformly transmitted through a plurality of the cemented carbide balls 24.

The guide groove 25 serves as a limiting mechanism, the cemented carbide ball 24 rolls within a limiting range defined by the guide groove 25, and a maximum bending angle of the flexible pup joint 17 may be adjusted by changing the position of the guide groove 25.

The contact position between the shaft tube 22 and the ball cage sleeve 21 is provided with a plurality of dynamic seals. Specifically, a drilling fluid channel is formed in the shaft tube 22, and an outer side of the shaft tube 22 is fitted and mounted with the star sleeve 23 through a keyway. The contact position between the shaft tube 22 and the ball cage sleeve 21 is provided with a plurality of dynamic seals to prevent the drilling fluid from leaking under a high pressure.

The circumferential limiting mechanism 26 is a keyway mechanism, and an outer side of the shaft tube 22 is mounted with the star sleeve 23 through the keyway mechanism.

Specifically, the circumferential limiting mechanism 26 may include a plurality of keys spaced apart in a circumferential direction of the shaft tube 22, and the plurality of keys are fixedly connected to an outer side wall of the shaft tube 22, with each key being extended in an axial direction of the shaft tube 22. The plurality of keys are respectively mated with a plurality of key slots provided on an inner side wall of the star sleeve 23, so as to prevent the shaft tube 22 and the star sleeve 23 from rotating relative to each other in the circumferential direction, thereby realizing the circumferential limiting.

In the present disclosure, the flexible power drilling tool 29 includes multi-section power drilling tools, each section of power drilling tool is of a stage with both ends provided with standardized threads (male and female threads), which can realize series connection of the multiple stages of power drilling tools in the flexible power drilling tool 29. The number of sections of the flexible power drilling tool 29 and the number of stages of a rotor 2914 are determined according to actual drilling needs, so as to achieve the target torque.

Figure 5A:
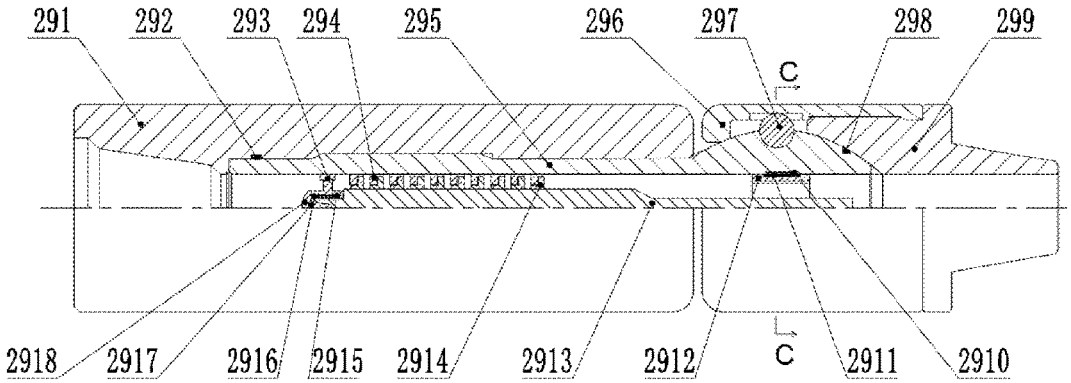
FIG. 5A is a schematic structural diagram of a pup joint of a flexible power drilling tool according to the present disclosure.
Figure 6:
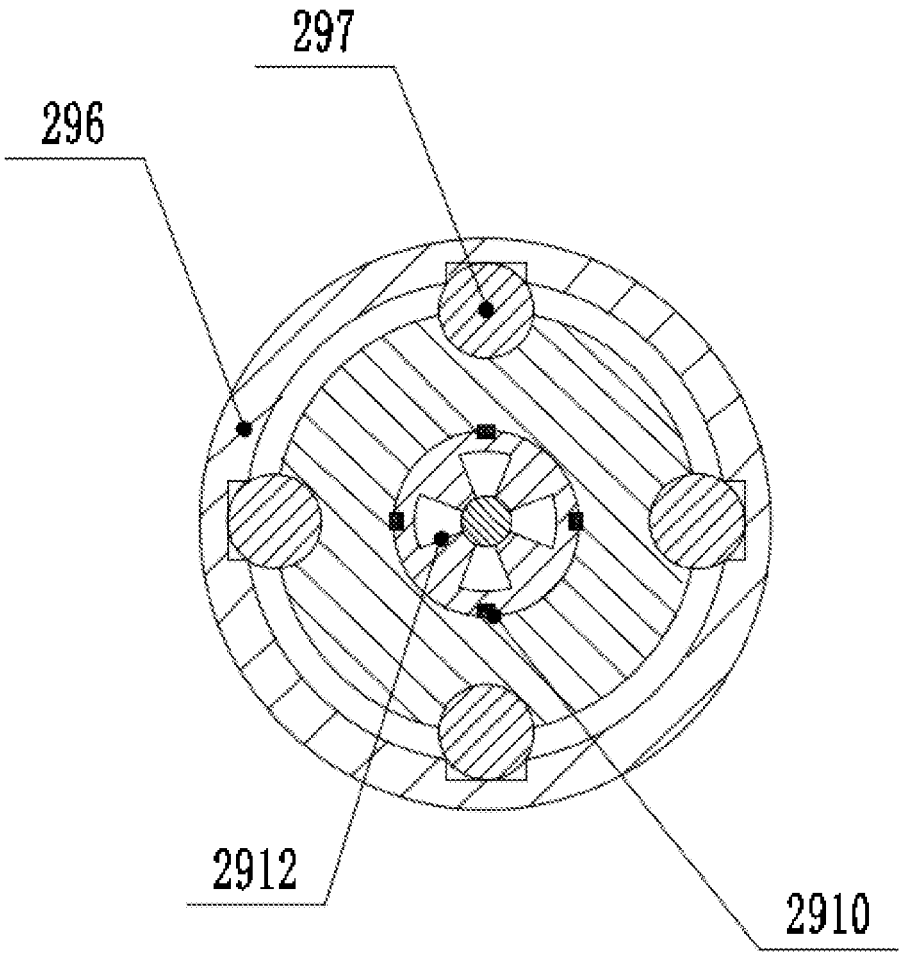
FIG. 6 is a cross-sectional view taken at a position C-C in FIG. 5.

In an embodiment, with reference to FIGS. 5A and 6, an external connection structure of the flexible power drilling tool 29 is the same as that of the flexible drill rod 8. The shaft tube 22 is internally provided with a turbine power unit, and the turbine power unit includes a turbine stator 294 and a turbine rotor 2914. The turbine rotor 2914 is fixed to the central transmission rod 295, and the other end of the central transmission rod 295 is connected to the shaft tube 22, so that the turbine rotor 2914, the transmission rod and the whole flexible power drilling tool 29 are driven by the drilling fluid flowing through the shaft tube 22 to rotate, thereby providing torque for the drill bit 9.

Figure 5B:
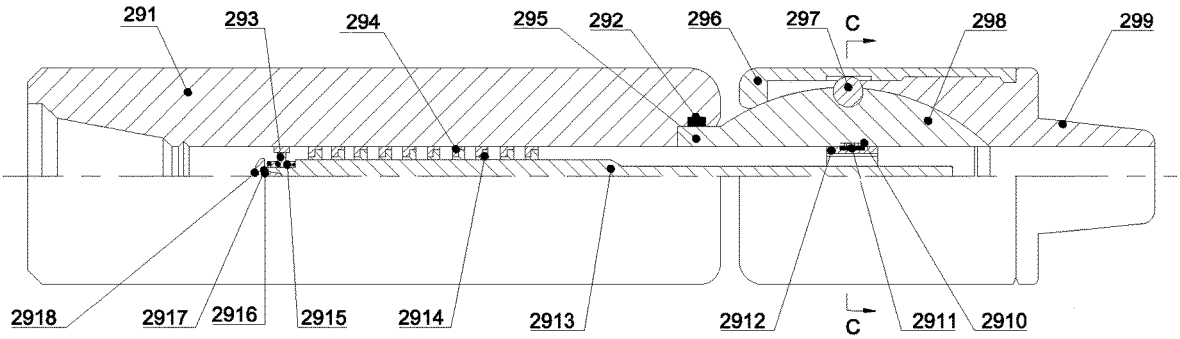
FIG. 5B is a schematic structural diagram of a pup joint of a flexible power drilling tool according to the present disclosure.

In another embodiment, with reference to FIGS. 5B and 6, an external connection structure of the flexible power drilling tool 29 is the same as that of the flexible drill rod 8. The flexible drilling tool upper joint 291 is internally provided with a turbine power unit, and the turbine power unit includes a turbine stator 294 and a turbine rotor 2914. The turbine rotor 2914 is fixed to an end of the mandrel 2913, and the other end of the mandrel 2913 is connected to the central transmission rod 295 through the first fluid director 2912, the limiting key 2910 and the spring shim 2911, so that the turbine rotor 2914, the mandrel 2913 and the whole flexible power drilling tool 29 are driven by the drilling fluid flowing through the flexible drilling tool upper joint 291 to rotate, thereby providing torque for the drill bit 9.

Each section of the flexible power drilling tool 29 is of one stage. The stator 294, the rotor 2914 and the central transmission rod 295 of each section of the flexible power drilling tool 29 are all mounted in the flexible drilling tool upper joint 291, without influencing the flexibility and the torque transmission of the drilling tool itself. Both ends of each section of drilling tool are provided with standardized threads (male and female threads). Multiple stages of the flexible power drilling tool 29 may be connected in series, and the number of stages of the flexible power drilling tool 29 may be adjusted according to the required torque.

The upper part of the flexible power drilling tool 29 is connected to the rotary joint 28 to ensure that the upper flexible drill rod 8 does not rotate, and only the lower flexible power drilling tool 29 rotates. The torque generated by the flexible power drilling tool 29 only acts on the lower drill bit 9 and will not be transmitted to the upper drilling tool assembly.

In the present disclosure, each section of the power drill is provided with the turbine stator 294, the turbine rotor 2914 and the mandrel 2913, which are inside the flexible drilling tool upper joint 291. One end of the mandrel 2913 is fixed to a center of the rotor 2914 through a keyway structure, and the other end of the mandrel 2913 is fixed to an inner wall of the central transmission rod 295 through a keyway structure (i.e., the limiting key 2910). By pushing the rotor 2914, the fluid causes the flexible power drilling tool 29 and the drill bit 9 to rotate.

In the present disclosure, outer surfaces of the flexible drill rod 8 and the flexible power drilling tool 29 are provided with ball sockets, where rolling cemented carbide balls 24 are provided to reduce the friction between the drilling tool and the borehole wall and improve the extension limit of the drilling.

In an embodiment, in order to ensure the sealing performance of the flexible power drilling tool 29, a first rubber seal 292 is provided between the flexible drilling tool upper joint 291 and the rod body part of the central transmission rod 295, and a second rubber seal 298 is provided between the flexible drilling tool lower joint 299 and the ball head part of the central transmission rod 295. A second flow director 293 is provided between the mandrel 2913 and the rod body part of the central transmission rod 295, the second flow director 293 is in threaded connection with the central transmission rod 295, and a blade direction of the second flow director 293 is perpendicular to a blade direction of the turbine power unit. One end of the mandrel 2913 located at the tube body part is provided with a limiting joint 2918, which is cooperated with the mandrel 2913 to axially limit the second fluid director 293. A periphery of the first fluid director 2912 is provided with a plurality of limiting keys 2910 for axially limiting the first fluid director 2912.

In the present disclosure, the working principle of the flexible power drilling tool 29 is as follows.

The external connection structure of the flexible power drilling tool 29 is the same as that of the flexible drill rod 8. The flexible drilling tool upper joint 291 is in threaded connection with the central transmission rod 295. The flexible drilling tool upper joint 291 is internally provided with a turbine power unit including a stator 294 and a rotor 2914, and the rotor 2914 is connected to a mandrel 2913, so that the turbine power unit drives the mandrel 2913 to rotate when the drilling fluid flows through the turbine power unit, the mandrel 2913 drives the central transmission rod 295 to rotate through the first flow director 2912, and the central transmission rod 295 rotates the limiting sleeve 296 through a ball 297. The limiting sleeve 296 is in threaded connection with the flexible drilling tool lower joint 299, so that the limiting sleeve 296 causes the flexible drilling tool lower joint 299 to rotate, and the flexible drilling tool lower joint 299 causes the lower drilling tool to rotate. That is, the flexible power drilling tool 29 can enable the lower drilling tool (such as the drill bit 9) to work under the action of drilling fluid.

In the flexible power drilling tool 29, the flexible drilling tool upper joint 291 and the central transmission rod 295 are in transition fit by the first rubber seal 292 to ensure a good sealing performance.

In the flexible power drilling tool 29, the second flow director 293 is fixedly connected to the flexible drilling tool upper joint 291, and an angular thrust ball bearing set 2915 is provided between the second flow director 293 and the mandrel 2913. The angular thrust ball bearing set 2915 may be limited by a bearing end cover 2916 and the mandrel 2913. A washer 2917 may be provided between the limiting joint 2918 and the mandrel 2913. The limiting joint 2918 and the mandrel 2913 have an axial limiting function on the second flow director 293. The blade direction of the second flow director 293 is perpendicular to a blade direction of the turbine power unit, so as to ensure that the drilling fluid vertically impacts on the blade of the turbine power rotor 2914 after flowing through the second flow director 293, thus maximizing the utilization of the flow energy of the drilling fluid.

In the flexible power drilling tool 29, the first fluid director 2912 connects the mandrel 2913 with the central transmission rod 295 to transmit a torque. The first fluid director 2912 may be provided with a plurality of (for example, four as illustrated in FIG. 6) round keys in the circumferential direction for limitation. A spring shim 2911 may be further provided between the first fluid director 2912 and the round keys to facilitate the arrangement of the round keys during assembly.

In the flexible power drilling tool 29, the ball 297 transmits the torque from the central transmission rod 295 to drive the limiting sleeve 296 to rotate. The ball 297 may enable the limiting sleeve 296 to drive the flexible drilling tool lower joint 299 and other drilling tools that are connected to the flexible drilling tool lower joint 299 to slide along the spherical surface of the central transmission rod 295, thus changing the bending degree of the drilling tool and making the power drilling tool be flexible. When the limiting sleeve 296 contacts the flexible drilling tool lower joint 299, the bending angle of the drilling tool is a limit bending angle of the flexible power drilling tool 29.

The present disclosure further discloses a coiled tubing flexible drill rod ultra-short radius radial drilling system, which includes the coiled tubing flexible drill rod ultra-short radius radial drilling string, and a whipstock device 13 and a hydraulic anchor 11 that are located in a main wellbore 27.

Figure 2:
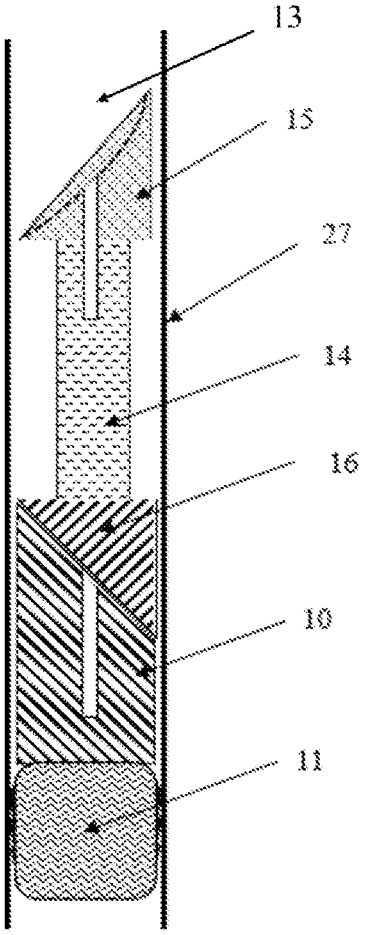
FIG. 2 is a schematic diagram of a whipstock device for multi-branch radial wells according to the present disclosure.

Referring to FIG. 2, in the present disclosure, an inclined plane of the whipstock device 13 for window cutting is designed with a large inclination angle, and an included angle of the inclined plane and an axial direction of the whipstock device 13 is greater than 15°. The whipstock device 13 includes, from top to bottom, a superimposed whipstock upper inclined plane 15, a connecting rod 14, a superimposed whipstock lower inclined plane 16 and a whipstock 10.

The superimposed whipstock upper inclined plane may be provided with an arc-shaped guide groove, and a central hole with a female thread. The central hole is in threaded connection with the fishing rod for retrieving the whipstock.

The lower whipstock is anchored by the hydraulic anchor 11, the superimposed whipstock lower inclined plane 16 is fitted with the inclined plane of the whipstock 10, the superimposed whipstock upper inclined plane is used for the new branch window cutting and deflection. The upper and lower inclined planes are connected by a solid rod. The distance between the upper and lower inclined planes is adjustable. The relative phases of the upper and lower inclined planes are adjustable.

When in use, the hydraulic anchor 11 is lowered through the coiled tubing 2 and provided with a gyroscope for positioning the azimuth of the keyway, and then is pressurized and set. According to an azimuth value measured by the gyroscope, the relative phases of the inclined plane of the whipstock and the keyway structure are adjusted on the ground. The whipstock device 13 is lowered to the well bottom through the coiled tubing 2, and the deflector 10 is connected and fixed with the hydraulic anchor 11 through the keyway structure to realize the lowering and positioning of the whipstock device 13. Next, the motor is started at a low displacement to cause the drilling tool to rotate, so that the drilling tool is disconnected from the whipstock device 13.

Specifically, the specific device configuration and the connection relationship of the coiled tubing flexible drill rod ultra-short radius radial drilling string of the drilling system may be varied depending on actual working conditions.

Specifically, in a first embodiment, the drilling string of the drilling system may include a coiled tubing 2 connected to an operating vehicle 1, a connector 3, a non-rotary joint 4, a safety release 5, a weighted drill rod 6, an activated screw motor 7, a flexible drill rod 8, a deactivated rotary joint 28, a deactivated flexible power drilling tool 29, and a drill bit 9, which are connected in sequence.

In a second embodiment, the drilling string includes a coiled tubing 2 connected to an operating vehicle 1, a connector 3, a non-rotary joint 4, a safety release 5, a weighted drill rod 6, an activated screw motor 7, a flexible drill rod 8, a deactivated rotary joint 28, a deactivated flexible power drilling tool 29, and a drill bit 9, which are connected in sequence.

In a third embodiment, the drilling string includes a coiled tubing 2 connected to an operating vehicle 1, a connector 3, a non-rotary joint 4, a safety release 5, a weighted drill rod 6, a deactivated screw motor 7, a flexible drill rod 8, an activated rotary joint 28, an activated flexible power drilling tool 29, and a drill bit 9, which are connected in sequence.

Different PDC drill bits 9 are adopted for steady inclined drilling and deflection. In the deflection stage, the flexible drill rod 8 is connected to a drill bit 9 with small-attack-angle and short-gauge (or no-gauge), and the outer diameter of the drill bit 9 is 4 mm to 6 mm larger than that of the flexible drill rod 8. In the drilling stage, a PDC drill bit 9 with large-attack-angle and long-gauge, the outer diameter of the drill bit 9 is approximate to that of the flexible drill rod 8, and a full-hole deflection is performed.

The present disclosure can realize the coiled tubing flexible drill rod ultra-short radius radial drilling. Specifically, the operating vehicle 1 and the flexible drill rod 8/flexible power drilling tool 29 are used to replace the workover rig and the conventional drill rod. The screw motor 7 and the flexible power drilling tool 29 form a two-stage power driver, which improves the power transmission efficiency and prolong service life of the tool. According to the present disclosure, the deflecting radius of 1 m to 12 m is adjustable, and a deflection can be directly performed in the reservoir, so that window cutting, deflection and horizontal drilling can all be completed in the target reservoir, thereby reducing useless footage, reducing the risk of complex accidents in caprock drilling, increasing the drainage area of the borehole, and improving the per-well production and the oil field recovery efficiency. By fitting the coiled tubing 2 with the flexible tubing string, it is unnecessary to make a single connection during lifting up and down, which reduces the labor of workers, shortens the radial well drilling cycle and decreases the multi-branch well drilling cost. In addition, the coiled tubing 2 is suitable for pressurized operations, which is convenient for further performing a fracturing operation and a well completion operation after the formation of the branch wellbore.

The coiled tubing flexible drill rod ultra-short radius radial drilling system according to the present disclosure has a plurality of operation modes. The present disclosure provides a coiled tubing flexible drill rod ultra-short radius radial drilling method for the coiled tubing flexible drill rod ultra-short radius radial drilling system, the method including:

when the coiled tubing flexible drill rod ultra-short radius radial drilling system is in a first operation mode, activating a screw motor 7 and a flexible power drilling tool 29 located at a lower part of a coiled tubing 2; a drill bit 9 is mounted at a lower end of a flexible drill rod 8, and both the screw motor 7 and the flexible power drilling tool 29 provide a torque and a weight on bit for the flexible drill rod 8 and the drill bit 9; during operation, the screw motor 7 remains in a main wellbore 27 without entering a branch wellbore, so as to realize ultra-short radius radial drilling; when the coiled tubing flexible drill rod ultra-short radius radial drilling system is in a second operation mode, only activating the screw motor 7 and deactivating the flexible power drilling tool 29; a lower end of the screw motor 7 is connected to the flexible drill rod 8, and the drill bit 9 is mounted at the lower end of the flexible drill rod 8; during operation, the screw motor 7 does not enter the branch wellbore, and provides a torque for the flexible drill rod 8 and the drill bit 9; during drilling, a rotation speed of the flexible drill rod 8 is controlled through a displacement, and an operating weight on bit is determined based on a rated torque of the screw motor 7; and when the coiled tubing flexible drill rod ultra-short radius radial drilling system is in a third operation mode, only activating the flexible power drilling tool 29 connected to the drill bit 9 below; during operation, the screw motor 7 is deactivated, the flexible drill rod 8 does not rotate, and the flexible power drilling tool 29 enters the sidetrack drilling branch wellbore along with the drill bit 9 to directly provide a torque for the drill bit 9 to realize rotary drilling.

Specifically, in the first operation mode, the operating vehicle 1, the coiled tubing 2, the connector 3, the non-rotary joint 4, the safety release 5, the weighted drill rod 6, the screw motor 7, the flexible drill rod 8, the activated rotary joint 28, the activated flexible power drilling tool 29, and the drill bit 9 are sequentially connected to form a drilling string.

In the first operation mode, the high-torque low-speed screw motor 7 and the flexible power drilling tool 29 that are located at the lower part of the coiled tubing 2 are all activated, and the drill bit 9 is mounted at the lower end of the flexible drill rod 8; both the screw motor 7 and the flexible power drilling tool 29 provide torques and weights on bit for the flexible drill rod 8 and the drill bit 9. During operation, the screw motor 7 remains in the main wellbore 27 without entering the branch wellbore (which is different from the sidetracking by the conventional coiled tubing 2), thus realizing the coiled tubing flexible drill rod ultra-short radius radial drilling.

In the second operation mode, the operating vehicle 1, the coiled tubing 2, the connector 3, the non-rotary joint 4, the safety release 5, the weighted drill rod 6, the activated screw motor 7, the flexible drill rod 8, the deactivated rotary joint 28, the deactivated flexible power drilling tool 29, and the drill bit 9 are sequentially connected to form a drilling string.

In the second operation mode, only the screw motor 7 is activated and the flexible power drilling tool 29 is deactivated. The lower end of the screw 7 is connected to the flexible drill rod 8, and the drill bit 9 is mounted at the lower end of the flexible drill rod 8. During operation, the screw motor 7 does not enter the branch wellbore, and provides a torque for the flexible drill rod 8 and the drill bit 9. During drilling, the rotation speed of the flexible drill rod 8 is controlled through the displacement, and the operating weight on bit is determined based on the rated torque of the motor.

In the third operation mode, the operating vehicle 1, the coiled tubing 2, the connector 3, the non-rotary joint 4, the safety release 5, the weighted drill rod 6, the deactivated screw motor 7, the flexible drill rod 8, the activated rotary joint 28, the activated flexible power drilling tool 29, and the drill bit 9 are sequentially connected to form a drilling string.

In the third operation mode, only the flexible power drilling tool 29 is activated and connected to the drill bit 9 below. During operation, the screw motor 7 is deactivated, the flexible drill rod 8 does not rotate, and the flexible power drilling tool 29 enters the sidetrack drilling branch wellbore along with the drill bit 9 to directly provide a torque for the drill bit 9 to realize rotary drilling.

The embodiments of the present disclosure further provide a coiled tubing flexible drill rod ultra-short radius radial drilling method, which may include the following steps:

1. scraping and washing a well;
2. performing setting and orienting by the coiled tubing 2 with a whipstock device 13;
3. performing window cutting and window repairing by the coiled tubing 2 with a flexible drilling tool;
4. performing a deflection by the coiled tubing 2 with the flexible drilling tool;
5. performing horizontal drilling by the coiled tubing 2 with the flexible drilling tool;
6. performing a multi-branch drilling operation;
7. performing a well completion operation; and
8. retrieving the whipstock device 13.

Specifically, when the well is scraped and washed, the coiled tubing 2 with a scraper may be used to repeatedly scrape the well at a target window cutting position for 3 times, and then wash the well.

When the coiled tubing 2 with a whipstock is used for setting and orientation, a hydraulic anchor 11 with a gyroscope may be lowered into a main wellbore 27 by the coiled tubing 2. During the process of lowing the drilling tool, the drilling tool is lowered slowly when it passes through a sleeve head 12; when the resistance exceeds 2 T, the drilling tool is lifted and then lowered; the drilling tool is filled with drilling fluid each time it is lowered 500 meters until it is lowered to the window cutting position. Then the drilling tool is moved up and down in a large range for 3 times to confirm that the torque is completely released during the lowering of the drilling tool. Next, pressurization and setting are carried out.

When the hydraulic anchor 11 is pressurized and set, the relative phases of the inclined plane of the whipstock and the keyway structure are adjusted on the ground according to the azimuth measured by the gyroscope. The whipstock device 13 is lowered to the well bottom by the coiled tubing 2, and the whipstock 10 is connected and fixed with the hydraulic anchor 11 through the keyway structure, so that the whipstock can be set and positioned. After that, the motor is started with a small displacement of 2 to 3 L/s to drive the drilling tool to rotate for at least 100 turns, so as to disconnect the drilling tool from the whipstock device 13. After a complete disconnection, the coiled tubing 2 is pulled out.

When the coiled tubing 2 with a flexible drilling tool is used to perform window cutting and window repairing, the drilling tool assembly consists of the coiled tubing 2, the connector 3, the non-rotary joint 4, the safety release 5, the weighted drill rod 6, the screw motor 7, the flexible drill rod 8, and a window-cutting tapered mill. The screw motor 7 is connected to the flexible drill rod 8 and the window-cutting tapered mill below. An initial weight on bit is 0.5 to 1 t, and after stabilization, the weight on bit gradually increases to 3 t. The displacement is controlled at 500 to 700 L/min. After a footage of 0.6 to 0.7 m, the window is repaired for 3 times, and then the drilling tool is pulled out.

When the coiled tubing 2 with the flexible drilling tool is used to perform a deflection, the corresponding mode may be selected according to the requirement (the target length of the radial well). Mode 1: the drilling tool assembly consists of the coiled tubing 2, the connector 3, the non-rotary joint 4, the safety release 5, the weighted drill rod 6, the screw motor 7, the flexible drill rod 8 and a deflecting drill bit 9. The screw motor 7 is connected to the flexible drill rod 8 and the deflecting drill bit 9 below. Mode 2: the drilling tool assembly consists of the coiled tubing 2, the connector 3, the safety release 5, the weighted drill rod 6, the flexible drill rod 8, the rotary joint 28, the flexible power drilling tool 29, and the deflecting drill bit 9. Both the Mode 1 and the Mode 2 adopt a drill bit 9 with small-attack-angle and short-gauge for the deflection, and a crown outer diameter of the drill bit 9 is approximate to the size of the flexible drill rod 8. During deflection, a high weight on bit of 3 to 4 t and a low displacement of 300 to 400 L/min are adopted to ensure the adequate deflection.

When the coiled tubing 2 with the flexible drilling tool is used to perform horizontal drilling, the corresponding mode may be selected according to the requirement (the target length of the radial well). Mode 1: the drilling tool assembly consists of the coiled tubing 2, the connector 3, the non-rotary joint 4, the safety release 5, the weighted drill rod 6, the screw motor 7, the flexible drill rod 8 and a PDC drill bit 9. Mode 2: the drilling tool assembly consists of the coiled tubing 2, the connector 3, the safety release 5, the weighted drill rod 6, the flexible drill rod 8, the rotary joint 28, the flexible power drilling tool 29 and the PDC drill bit 9. Both the Mode 1 and the Mode 2 adopt a drill bit 9 with large-attack-angle and long-gauge to improve the formation cutting and inclination stabilizing capacity. During the horizontal drilling, a low weight on bit of 1 to 2 t and a high displacement of 500 to 700 L/min are adopted.

During the multi-branch drilling operation, branch wells are built from bottom to top. If there is a small distance between positions of window-cutting points of the branch wells, a length of the connecting rod 14 of the superimposed whipstock is determined based on a depth difference between the window-cutting points of the branch wells. The azimuths of the superimposed whipstock upper inclined plane 15 and the superimposed whipstock lower inclined plane 16 are set on the ground according to an azimuth of the whipstock in the downhole. The superimposed whipstock lower inclined plane 16 is fitted and fixed with the inclined plane of the lower whipstock 10, and the superimposed whipstock upper inclined plane 15 is oriented at the predetermined azimuth. The set superimposed whipstock is lowered to the well bottom by the coiled tubing 2. Next, steps 3 to 6 are repeated. If there is a large distance (hundreds of meters) between the positions of the window-cutting points of the adjacent branch wells, steps 1 to 6 are repeated directly.

During well completion: an open hole completion, a flexible screen pipe completion or a flexible string fracturing, etc. may be selected according to the design requirement.

During whipstock retraction: after the operation, the coiled tubing 2 and the screw motor 7 are put into the well with a fishing rod; after bottom flushing, the pump is stopped and the fishing rod is lowered into a central hole of the whipstock device 13, and the motor is controlled to rotate for a short time with a low displacement for to connect the fishing rod to whipstock device 13. If the lifting hang weight is obvious, the coiled tubing 2 is lifted to retrieve the whipstock device 13, and if the lifting hang weight is not obvious, the fishing rod is lowered into the central hole of the whipstock device 13 and the motor is controlled to rotate again to connect the fishing rod to whipstock device 13 until the hang weight is obvious.

The present disclosure can realize ultra-short radius deflection with an arbitrary curvature radius in a range of 1 m to 12 m, with an adjustable deflecting rate of 5°/m to 57°/m, and can complete window cutting, deflection and drilling in the same thin layer, thus reducing useless footage and avoiding complex accident risks such as clay expansion and water hole blockage during drilling of upper mudstone and other caprocks. Meanwhile, by combining the coiled tubing 2 with the flexible drill rod 8 and the flexible drilling tool, the frequent single connection in the conventional method is avoided, which helps to realize rapid and efficient deflection drilling and shorten the construction period and cost. In addition, the present disclosure is suitable for pressurized operations, which is convenient for further performing a fracturing operation and a well completion operation after the formation of the branch wellbore.

REFERENCE NUMERALS

1. operating vehicle; 2. coiled tubing; 3. connector; 4. non-rotary joint; 5. safety release; 6. weighted drill rod; 7. screw motor; 8. flexible drill rod; 9. drill bit; 10. whipstock; 11. hydraulic anchor; 12. sleeve head; 13. whipstock device; 14. connecting rod; 15. superimposed whipstock upper inclined plane; 16. superimposed whipstock lower inclined plane; 17. flexible pup joint; 18. flexible-drill-rod upper joint; 19. flexible-drill-rod lower joint; 20. steel ball; 21. ball cage sleeve; 22. shaft tube; 23. star sleeve; 24. cemented carbide ball; 25. guide groove; 26. circumferential limiting mechanism; 27. wellbore; 28. rotary joint; 29. flexible power drilling tool; 291. flexible drilling tool upper joint; 292. first rubber seal; 293. second flow director; 294. stator; 295. central transmission rod; 296. limiting sleeve; 297. ball; 298. second rubber seal; 299. flexible drilling tool lower joint; 2910. limiting key; 2911. spring shim; 2912. first fluid director; 2913. mandrel; 2914. rotor; 2915. angular thrust ball bearing set; 2916. bearing end cover; 2917. washer; 2918. limiting joint.

It should be noted that in the description of present disclosure, the terms such as 'first' and 'second' are only used for description purposes and to distinguish similar objects. There is no sequence between the terms, and they cannot be understood as indicating or implying relative importance. In addition, in the description of present disclosure, unless otherwise specified, 'a plurality of' means two or more.

The above embodiments in the present disclosure are described in a progressive way, and the same and similar parts of the embodiments can be referred to each other. Each embodiment lays an emphasis on its distinctions from other embodiments.

Those described above are just several embodiments of the present disclosure. Although the disclosed embodiments of the present disclosure are given as above, they are only adopted to facilitate the understanding of the present disclosure, and are not intended to limit the present disclosure.

Any person skilled in the art of the present disclosure can make modifications and changes in the form and details of the embodiments without departing from the spirit and scope of the present disclosure. The patent protection scope of the present disclosure should still be subject to the scope defined by the appended claims.

What is claimed is:

1. A method for coiled tubing flexible drill rod ultra-short radius radial drilling for a system which is a coiled tubing flexible drill rod ultra-short radius radial drilling system, wherein the system comprises a plurality of operation modes, and the method comprises:

when the coiled tubing flexible drill rod ultra-short radius radial drilling system is in a first operation mode, activating a screw motor and a flexible power drilling tool that are located at a lower part of a coiled tubing, wherein a drill bit is mounted at a lower end of a flexible drill rod, and both the screw motor and the flexible power drilling tool provide a torque and a weight on bit for the flexible drill rod and the drill bit; during operation, the screw motor remains in a main wellbore without entering a branch wellbore, so as to realize ultra-short radius radial drilling;

when the coiled tubing flexible drill rod ultra-short radius radial drilling system is in a second operation mode, activating only the screw motor and deactivating the flexible power drilling tool, wherein a lower end of the screw motor is connected to the flexible drill rod, and the drill bit is mounted at the lower end of the flexible drill rod; during operation, the screw motor does not enter the branch wellbore, and provides a torque for the flexible drill rod and the drill bit; during drilling, a rotation speed of the flexible drill rod is controlled through a fluid flow from a pump, and an operating weight on bit is determined based on a rated torque of the screw motor; and when the coiled tubing flexible drill rod ultra-short radius radial drilling system is in a third operation mode, activating only the flexible power drilling tool connected to the drill bit below; during operation, the screw motor is deactivated, the flexible drill rod does not rotate, and the flexible power drilling tool enters the sidetrack drilling branch wellbore along with the drill bit to directly provide a torque for the drill bit to realize rotary drilling.

2. The method according to claim 1, wherein in the first operation mode, an operating vehicle, the coiled tubing, a connector, a non-rotary joint, a safety release, a weighted drill rod, the screw motor, the flexible drill rod, an activated rotary joint, the activated flexible power drilling tool, and the drill bit are sequentially connected to form a drilling string;

wherein in the second operation mode, the operating vehicle, the coiled tubing, the connector, the non-rotary joint, the safety release, the weighted drill rod, the activated screw motor, the flexible drill rod, the deactivated rotary joint, the deactivated flexible power drilling tool, and the drill bit are sequentially connected to form a drilling string; and wherein in the third operation mode, the operating vehicle, the coiled tubing, the connector, the non-rotary joint, the safety release, the weighted drill rod, the deactivated screw motor, the flexible drill rod, the activated rotary joint, the activated flexible power drilling tool, and the drill bit are sequentially connected to form a drilling string.

3. The method according to claim 1, comprising:

scraping and washing a well;

performing setting and orienting by the coiled tubing with a whipstock device;

performing window cutting and window repairing by the coiled tubing with a flexible drilling tool;

performing a deflection by the coiled tubing with a flexible drilling tool;

performing horizontal drilling by the coiled tubing with the flexible drilling tool;

performing multi-branch drilling operation;

performing a well completion operation; and retrieving the whipstock device.

4. A string which is a coiled tubing flexible drill rod ultra-short radius radial drilling string, which at least comprises a flexible drill rod and a flexible power drilling tool;

the flexible drill rod comprises a plurality of flexible pup joints, any adjacent two of which are connected by a movable mechanism which can transfer both a torque and a weight on bit;

the flexible power drilling tool comprises a flexible drilling tool upper joint, and a central transmission rod connected to the flexible drilling tool upper joint; the central transmission rod is a hollow revolution structure and comprises a tube body part located on the flexible drilling tool upper joint and a ball head part that is extended out of the flexible drilling tool upper joint; a mandrel is provided inside the central transmission rod;

a turbine power unit is provided between the tube body part and the mandrel, one end of the mandrel extending out of the flexible drilling tool upper joint is in transmission connection with a first fluid director, the first fluid director is in transmission connection with the ball head part, the ball head part is in transmission connection with a limiting sleeve through a ball-valve, and the limiting sleeve is connected to a flexible drilling tool lower joint; and when drilling fluid flows through the turbine power unit, the turbine power unit drives the mandrel to rotate, the mandrel causes the central transmission rod to rotate through the first fluid director, and the central transmission rod causes the flexible drilling tool lower joint to rotate through the ball and the limiting sleeve.

5. The string according to claim 4, wherein a ball cage sleeve, a star sleeve, and a shaft tube are provided from outside to inside at a connecting position of any adjacent two of the flexible pup joints, and a circumferential limiting mechanism for torque transmission is provided between the shaft tube and the star sleeve; a spherical guide groove is formed between the ball cage sleeve and the star sleeve, and a cemented carbide ball for torque transmission is provided in the guide groove.

6. The string according to claim 5, wherein the guide groove serves as a limiting mechanism, and the cemented carbide ball is capable of rolling in a range defined by the limiting mechanism to adjust a maximum bending angle of the flexible pup joint.

7. The string according to claim 5, wherein a drilling fluid channel is formed inside the shaft tube, the circumferential limiting mechanism is a keyway mechanism comprising a slot and a key matched with the slot, and an outer side of the shaft tube is mounted with the star sleeve through the keyway mechanism.

8. The string according to claim 7, wherein a contact position between the shaft tube and the ball cage sleeve is provided with a plurality of dynamic seals.

9. The string according to claim 4, wherein a first rubber seal is provided between the flexible drilling tool upper joint and the rod body part of the central transmission rod, and a second rubber seal is provided between the flexible drilling tool lower joint and the ball head part of the central transmission rod.

10. The string according to claim 4, wherein a second flow director is provided between the rod body part of the central transmission rod and the mandrel, the second flow director is in threaded connection with the central transmission rod, and a blade direction of the second flow director is perpendicular to a blade direction of the turbine power unit.

11. The string according to claim 10, wherein one end of the mandrel at the tube body part is provided with a limiting joint, which is cooperated with the mandrel to axially limit the second fluid director.

12. The string according to claim 10, wherein a periphery of the first fluid director is provided with a plurality of limiting keys for axially limiting the first fluid director.

13. A system which is a coiled tubing flexible drill rod ultra-short radius radial drilling system, comprising the coiled tubing flexible drill rod ultra-short radius radial drilling string according to claim 4, and a whipstock device and a hydraulic anchor that are located in a main wellbore.

14. The system according to claim 13, wherein the whipstock device comprises, from top to bottom, a superimposed whipstock upper inclined plane, a connecting rod, a superimposed whipstock lower inclined plane, and a whipstock.

15. The system according to claim 13, wherein the drilling string comprises a coiled tubing connected to an operating vehicle, a connector, a non-rotary joint, a safety release, a weighted drill rod, a screw motor, a flexible drill rod, an activated rotary joint, an activated flexible power drilling tool, and a drill bit, which are connected in sequence.

16. The system according to claim 13, wherein the drilling string comprises a coiled tubing connected to an operating vehicle, a connector, a non-rotary joint, a safety release, a weighted drill rod, an activated screw motor, a flexible drill rod, a deactivated rotary joint, a deactivated flexible power drilling tool, and a drill bit, which are connected in sequence.

17. The system according to claim 13, wherein the drilling string comprises a coiled tubing connected to an operating vehicle, a connector, a non-rotary joint, a safety release, a weighted drill rod, a deactivated screw motor, a flexible drill rod, an activated rotary joint, an activated flexible power drilling tool, and a drill bit, which are connected in sequence.

* * * * *